US008653916B2

(12) United States Patent
Naka et al.

(10) Patent No.: US 8,653,916 B2
(45) Date of Patent: Feb. 18, 2014

(54) ELECTROMAGNETIC CONTACTOR

(75) Inventors: Yasuhiro Naka, Kounosu (JP); Koji Okubo, Kounosu (JP); Kouetsu Takaya, Kounosu (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/500,787

(22) PCT Filed: Feb. 10, 2011

(86) PCT No.: PCT/JP2011/000752

§ 371 (c)(1), (2), (4) Date: Jun. 4, 2012

(87) PCT Pub. No.: WO2012/004909

PCT Pub. Date: Jan. 12, 2012

(65) Prior Publication Data

US 2013/0127570 A1 May 23, 2013

(30) Foreign Application Priority Data

Jul. 8, 2010 (JP) ..... 2010-155449

(51) Int. Cl.
*H01H 67/02* (2006.01)
*H01H 3/00* (2006.01)

(52) U.S. Cl.
USPC ..... 335/192; 335/131

(58) Field of Classification Search
USPC ..... 335/127, 132, 192, 131
See application file for complete search history.

(56) References Cited

U.S. PATENT DOCUMENTS

| | | | | | |
|---|---|---|---|---|---|
| 4,503,409 | A * | 3/1985 | Lerude et al. | 335/132 |
| 4,525,694 | A * | 6/1985 | Dennison et al. | 335/132 |
| 4,590,450 | A * | 5/1986 | Blum | 335/129 |
| 5,014,027 | A * | 5/1991 | Ootsuka | 333/132 |
| 5,075,660 | A * | 12/1991 | Ootsuka | 335/131 |
| 5,081,436 | A * | 1/1992 | Nishi et al. | 335/83 |
| 5,243,313 | A * | 9/1993 | Basnett | 335/247 |
| 5,844,457 | A * | 12/1998 | Eckroth et al. | 335/132 |
| 6,037,852 | A * | 3/2000 | Pfab | 335/274 |
| 6,239,679 | B1 * | 5/2001 | Comtois et al. | 335/132 |
| 7,692,522 | B2 * | 4/2010 | Hartinger et al. | 335/131 |
| 7,760,055 | B2 * | 7/2010 | Adunka et al. | 335/8 |
| 2003/0052760 | A1 * | 3/2003 | Smith | 335/132 |
| 2008/0036561 | A1 * | 2/2008 | Hartinger et al. | 335/156 |

FOREIGN PATENT DOCUMENTS

| | | |
|---|---|---|
| JP | S59-71549 | 5/1984 |
| JP | S64-048339 | 2/1989 |
| JP | H06-86245 | 12/1994 |

* cited by examiner

*Primary Examiner* — Alexander Talpalatski
(74) *Attorney, Agent, or Firm* — Manabu Kanesaka

(57) ABSTRACT

Provided is an electromagnetic contactor (20) which transmits an attraction movement of a movable core (8*d*) of an electromagnet (8), via a drive lever (9), to a movable contact support (7*a*) that is movable in parallel with the movable core (8*d*), wherein an urging portion (21) for applying an urging force to the movable core (8*d*) is provided such that the movable core (8*d*) is held at a movable core initial position which is apart from a fixed core (8*c*) and does not allow engagement with the movable contact support (7*a*).

4 Claims, 7 Drawing Sheets

ELECTROMAGNETIC CONTACTOR

RELATED APPLICATIONS

The present application is National Phase of International Application No. PCT/JP2011/000752 filed Feb. 10, 2011, and claims priority from Japanese Application No. 2010-155449, filed Jul. 8, 2010.

TECHNICAL FIELD

The present invention relates to an electromagnetic contactor which transmits an attraction movement of a movable core of an electromagnet, via a drive lever, to a movable contact support that is movable in parallel with the movable core.

BACKGROUND ART

As an electromagnetic contactor, there is known a device which accommodates, in a case, an electromagnet having a movable core, a movable contact support which moves in parallel with directions of movement of the movable core (an attraction movement, a release movement), a return spring which urges the movable contact support toward its initial position, and a drive lever which transmits the movement of the movable core to the movable contact support (e.g., Patent Document 1).

A description is given of the conventional electromagnetic contactor of this type with reference to FIGS. 6 and 7. As shown in FIG. 6, an electromagnetic contactor 1 includes a lower case 3 and an upper case 4, and in the upper case 4, there are disposed a plurality of terminal portions each having a contact (reference numerals 10*a* to 10*d* in FIG. 7), and a coil terminal of an electromagnet 8 described later. The upper opening portion of the upper case 4 is covered with an arc extinguishing cover 5.

In the upper case 4, a movable contact support 7*a* is accommodated. The movable contact support 7*a* includes a movable contact support base 7*a*1, and a movable contact support cover 7*a*2 which is coupled to the movable contact support base 7*a*1 in a fitting manner.

As shown in FIG. 7, the movable contact support base 7*a*1 is formed with a plurality of partitions 13 at predetermined intervals, and movable contacts 7*c*1 to 7*c*4 are supported between the partitions 13.

The terminal portions 10*a* to 10*d* disposed in a row in the upper case 4 are provided with contact pieces 12 protruding toward the movable contact support base 7*a*1, a normally open fixed contact TNO is formed on one side surface of the tip of the contact piece 12 of each of the terminal portions 10*a* and 10*b*, and a normally closed fixed contact TNC is formed on the other side surface of the tip of the contact piece 12 of each of the terminal portions 10*c* and 10*d*.

The movable contacts 7*c*1 and 7*c*2 of the movable contact support base 7*a*1 oppose the normally open fixed contacts TNO of the terminal portions 10*a* and 10*b*, and are urged by contact springs 14 in a direction in which the movable contacts 7*c*1 and 7*c*2 are moved away from the partitions 13. In addition, the movable contacts 7*c*3 and 7*c*4 of the movable contact support 7*a*1 oppose the normally closed fixed contacts TNC of the terminal portions 10*c* and 10*d*, and are urged by contact springs 15 in a direction in which the movable contacts 7*c*3 and 7*c*4 are moved away from the partitions 13.

At one end portion in a longitudinal direction of the movable contact support base 7*a*1, a return spring 7*b* is disposed, and the movable contact support 7*a* is urged by the urging force of the return spring 7*b* toward the right in FIG. 6.

In the lower case 3, an AC-operated electromagnet 8 is accommodated. The electromagnet 8 includes a coil frame 8*b* having an exciting coil 8*a* wound therearound, a fixed core 8*c* which is inserted into the hollow portion of the coil frame 8*b* and fixed to the side wall of the lower case 3, and a movable core 8*d* which opposes the fixed core 8*c* so as to be movable close to or away from the fixed core 8*c* and is inserted into the hollow portion of the coil frame 8*b*, and is disposed such that the movement directions of the movable core 8*d* (the attraction movement and the release movement) are in parallel with the movement direction of the movable contact support 7*a*.

In addition, a drive lever 9, which transmits the attraction movement and the release movement of the movable core 8*d* to the movable contact support 7*a*, is accommodated so as to be extended between the lower case 3 and the upper case 4 in a state where the drive lever 9 is connected to the other end side of the movable contact support 7*a* which is apart from the return spring 7*b* and the movable core 8*d*.

The drive lever 9 is a plate-like member. In the drive lever 9, one end thereof in a longitudinal direction is engaged with the inner wall of the arc extinguishing cover 5 to serve as a rotation shaft portion 9*a*, a movable core connection portion 9*b* formed on the other end side in the longitudinal direction is inserted into and connected to a connection hole 8*e* formed in the movable core 8*d*, and a movable contact support connection portion 9*c* formed in the central portion in the longitudinal direction is engageable with the other end side of the movable contact support 7*a*.

When the exciting coil 8*a* of the electromagnet 8 is in a non-excited state, an attraction force does not act between the fixed core 8*c* and the movable core 8*d*, and the movable contact support 7*a* is positioned on the right in FIG. 6 by the urging force of the return spring 7*b* (an initial position of the movable contact support 7*a*). At this point, the movable contacts 7*c*1 and 7*c*2 of the movable contact support 7*a* are apart from the normally open fixed contacts TNO of the terminal portions 10*a* and 10*b* to serve as contacts, while the movable contacts 7*c*3 and 7*c*4 are contacting with the normally closed fixed contacts TNC of the terminal portions 10*c* and 10*d* to serve as b contacts.

When the exciting coil 8*a* of the electromagnet 8 is brought into an excited state, the attraction force acts between the fixed core 8*c* and the movable core 8*d*, and the movable core 8*d* performs the attraction movement toward the fixed core 8*c*. When the movable core 8*d* performs the attraction movement in which the movable core 8*d* moves to the left in FIG. 6, the drive lever 9 rotates clockwise with the rotation shaft portion 9*a* serving as the rotation shaft, the movable contact support 7*a* pushed by the movable contact support connection portion 9*c* moves to a contact switching position against the return spring 7*b*. When the movable contact support 7*a* has moved to the contact switching operation position, the movable contacts 7*c*1 and 7*c*2 of the movable contact support 7*a* contact with the normally open fixed contacts TNO of the terminal portions 10*a* and 10*b*, while the movable contacts 7*c*3 and 7*c*4 are moved away from the normally closed fixed contacts TNC of the terminal portions 10*c* and 10*d*.

Patent Document 1: Japanese Utility Model Application Publication No. H6-86245

By the way, in the conventional electromagnetic contactor 1 having the structure described above, when the movable contact support 7*a* shown in FIG. 6 is at the initial position, the movable core 8*d* of the electromagnet 8 is movable in the direction in which the movable core 8*d* moves close to or away from the fixed core 8*c*.

As a result, in the conventional electromagnetic contactor 1, when a part of an impact force applied from the outside is transmitted as a force F which moves the movable core 8*d* toward the fixed core 8*c*, the movement of the movable core 8*d* is transmitted to the movable contact support 7*a* via the drive lever 9, and a malfunction in which the b contacts are temporarily disconnected may be caused.

As a countermeasure against the malfunction of the electromagnetic contactor 1 resulting from the impact, there may be used a structure including the return spring 7*b* having the urging force increased such that the movable contact support 7*a* does not move even when a moving force resulting from the impact is applied from the drive lever 9.

However, the countermeasure against the malfunction requires the large electromagnet 8 having a large attraction force in proportion to the return spring 7*b* having the increased urging force when the movable contact support 7*a* is moved during the normal operation, and has a problem in terms of reducing the size of the electromagnetic contactor 1.

In addition, in the conventional electromagnetic contactor 1, a malfunction in which the a contacts temporarily contact with each other by the impact force applied from the outside may occur.

As a countermeasure against such malfunction of the electromagnetic contactor 1, there may be used a structure in which the a contacts do not contact with each other even when the movable contact support 7*a* is moved by the impact by setting a large gap amount between the contacts of the a contacts (distance between each of the movable contacts 7*c*1 and 7*c*2 and the normally open fixed contact TNO).

SUMMARY OF THE INVENTION

However, in the countermeasure against the malfunction, the stroke of the movable contact support 7*a* (a movement amount from the initial position to the contact switching position) is increased by increasing the gap between the contacts of the a contacts, and the dimension of the outer diameter of the upper case 4 accommodating the movable contact support 7*a* is thereby increased so that there is a problem in terms of the reduction in the size of the electromagnetic contactor 1.

In view of the foregoing, the present invention has been achieved by focusing on the unsolved problem of the conventional art described above, and an object thereof is to provide an electromagnetic contactor capable of enhancing operation reliability against the impact and achieving the reduction in the size thereof.

In order to achieve the above object, an electromagnetic contactor according to an embodiment of the present invention is an electromagnetic contactor including, a case accommodating: an electromagnet having a movable core performing an attraction movement by a generation of an attraction force between the movable core and a fixed core; a movable contact support moving between an initial position and a contact switching position in parallel with a movement direction of the movable core; a return spring urging the movable contact support toward the initial position; and a drive lever engaged with the movable core and the movable contact support, and transmitting the attraction movement of the movable core to the movable contact support as a movement toward the switching position, and an urging portion applying an urging force to the movable core to hold the movable core at the movable core initial position, which is apart from the fixed core and does not engage with the movable contact support.

According to the electromagnetic contactor according to the embodiment, after the movable core, which moves by an impact from the outside, moves a predetermined distance from the initial position where the movable core is held by the urging portion, the movable core is engaged with the movable contact support so that the movement distance required to cause b contacts to be disconnected by the impact is increased, and hence operation reliability against the impact is enhanced. In addition, it is not necessary to increase a gap amount between contacts of a contacts in order to enhance the operation reliability against the impact so that the stroke of the movable contact support is not increased and the dimension of the outer diameter of the case accommodating the movable contact support is not increased, and hence a reduction in the size of the electromagnetic contactor is achieved.

In addition, in the electromagnetic contactor according to the embodiment of the present invention, the electromagnet includes a coil frame having a hollow portion with a coil wound around, and the movable core is formed in substantially an E shape, and is disposed to face the fixed core on one end side of the coil frame. The movable core has a central leg inserted into the hollow portion of the coil frame and a pair of outside legs sandwiching the central leg, the central leg and the outside legs extending from a core base portion. The urging portion is a compression coil spring having both ends in an axial direction contacting with a wall surface on one end side of the coil frame and the core base portion of the movable core in a state where the central leg of the movable core is inserted into the compression coil spring.

According to the electromagnetic contactor according to the embodiment, it is possible to effectively use a space around the movable core as a space for accommodating the compression coil spring, and hence the reduction in the size of the electromagnetic contactor is further achieved.

Further, in the electromagnetic contactor according to the embodiment of the present invention, the compression coil spring is a conical coil spring.

According to the electromagnetic contactor according to the embodiment, the conical coil spring is not decentered when compressed, and a coil minor diameter portion enters into a coil major diameter portion, and hence it becomes possible to apply a linear urging force to the movable core.

Furthermore, in the electromagnetic contactor according to the embodiment of the present invention, a coil major diameter end portion of the conical coil spring is contacting with the core base portion of the movable core.

According to the electromagnetic contactor according to the embodiment, the coil major diameter end portion of the conical coil spring increases the contact area with the movable core performing the attraction movement, and hence the conical coil spring is prevented from being decentered when compressed or extended.

Moreover, in the electromagnetic contactor according to the embodiment of the present invention, the urging force urging the movable contact support toward the initial position is a force combining the urging force of the urging portion which is transmitted to the movable contact support via the movable core and the drive lever and an urging force of the return spring.

According to the electromagnetic contactor according to the embodiment, the return spring generates the urging force acting on the movable contact support toward the initial position in cooperation with the urging portion in a sharing manner, and the urging force combining the urging forces of the urging portion and the return spring is equal to that of the return spring of the conventional device, and hence the electromagnet capable of generating a large attraction force is not required and the reduction in the size of the electromagnetic contactor is further achieved.

According to the electromagnetic contactor according to the present invention, since the movable core which moves by the impact from the outside is engaged with the movable contact support after moving the predetermined distance from the initial position where the movable core is held by the urging portion so that the movement distance required to cause the b contacts to be disconnected by the impact is increased, it is possible to enhance the operation reliability against the impact and, since it is not necessary to increase the gap amount between the contacts of the a contacts in order to enhance the operation reliability against the impact so that the stroke of the movable contact support is not increased and the dimension of the outer diameter of the case accommodating the movable contact support is not increased, it is possible to achieve the reduction in the size of the electromagnetic contactor.

BEST MODE FOR CARRYING OUT THE INVENTION

Figure 1:
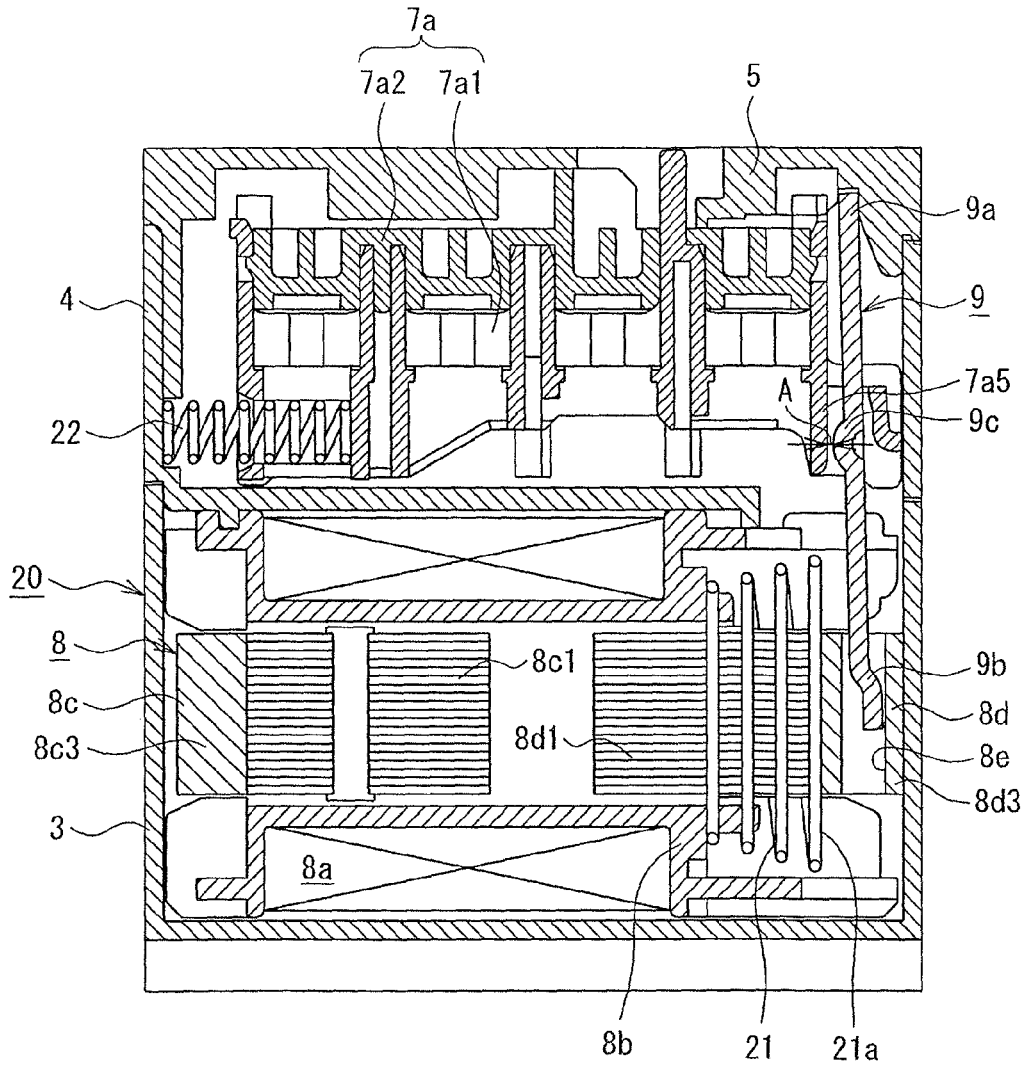
FIG. 1 is a cross-sectional view showing an initial state of an electromagnetic contactor according to the present invention.

A description is given hereinbelow of a best mode for carrying out the present invention (hereinafter referred to as an embodiment) with reference to the drawings. Note that the description of components which are the same as those shown in FIGS. 6 and 7 will be omitted by retaining the same reference numerals.

As shown in FIG. 1, an electromagnetic contactor 20 of the present embodiment includes a compression-type movable core spring 21 in a conical coil shape which urges the movable core 8*d* of the electromagnet 8 in a direction in which the movable core 8*d* is moved away from the fixed core 8*c* to hold the movable core 8*d* at an initial position, and a return spring 22 disposed at one end portion in a longitudinal direction of the movable contact support a urges the movable contact support 7*a* toward an initial position in cooperation with the movable core spring 21 in a sharing manner.

Figure 2:
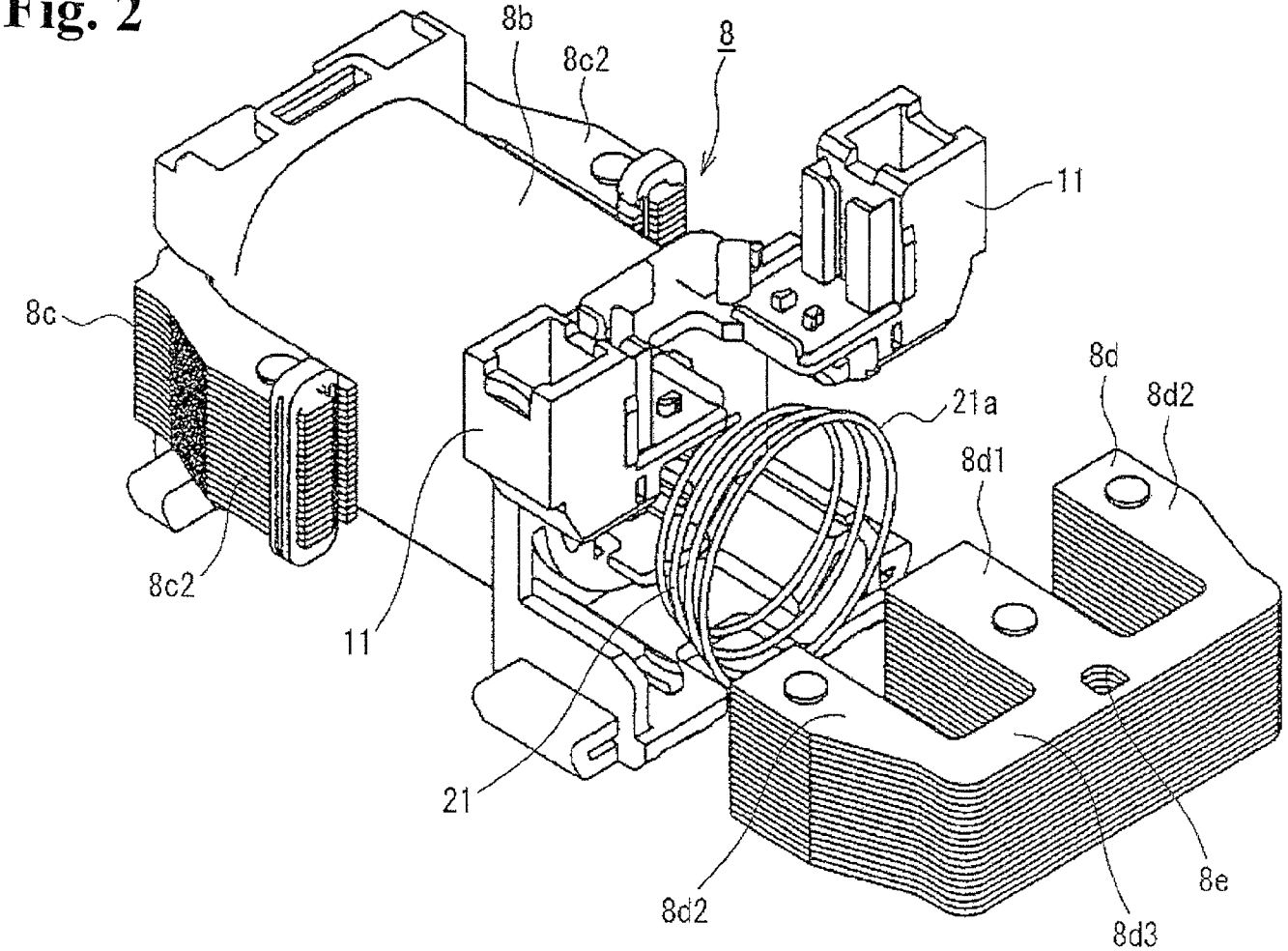
FIG. 2 is a perspective view showing a principal portion of the electromagnetic contactor according to the present invention.
Figure 3:
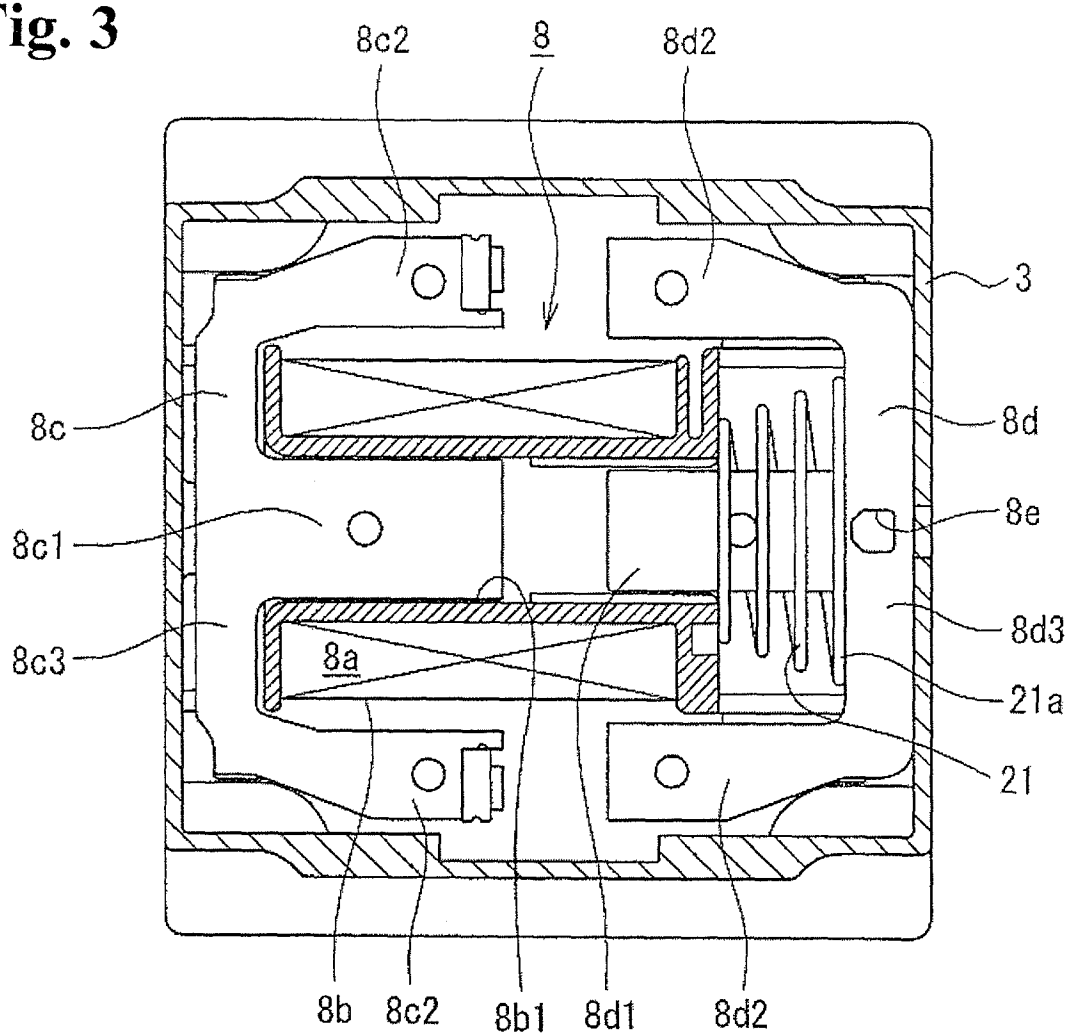
FIG. 3 is a cross-sectional view showing a principal portion of the electromagnetic contactor according to the present invention.

As shown in FIGS. 2 and 3, the AC-operated electromagnet 8 accommodated in the lower case 3 includes the coil frame 8*b* having the exciting coil 8*a* wound around the outer peripheral surface thereof and provided with a hollow portion 8*b*1, the fixed core 8*c* disposed on one end side of the coil frame 8*b*, the movable core 8*d* disposed on the other end side of the coil frame 8*b*, and a pair of integrally formed coil terminals 11 which are spaced apart from each other on the other end side of the coil frame 8*b* in which the movable core 8*d* is disposed. Note that the pair of coil terminals 11 are disposed in alignment with the terminal portions 10*a* to 10*d* each having the contact attached in the upper case 4.

The fixed core 8*c* is a generally E-shaped member having a central leg 8*c*1 and a pair of outside legs 8*c*2 sandwiching the central leg 8*c*1 which extends in parallel with each other from a core base portion 8*c*3, and the central leg 8*c*1 is inserted into the hollow portion 8*b*1 of the coil frame 8*b* and fixed thereto.

The movable core 8*d* is a generally E-shaped member having a central leg 8*d*1 and a pair of outside legs 8*d*2 sandwiching the central leg 8*d*1 which extend in parallel with each other from a core base portion 8*d*3, and the central leg 8*d*1 is movably inserted into the hollow portion 8*b*1 of the coil frame 8*b*.

The movable core spring 21 is disposed in a state where, with the central leg 8*d*1 of the movable core 8*d* inserted thereinto, the movable spring 21 is compressed with both end portions thereof contacting with the end surface on the other end side of the coil frame 8*b* and the core base portion 8*d*3. A major diameter end portion 21*a* of the movable core spring 21 having the conical coil shape is contacting with the wall surface of the core base portion 8*d*3 positioned between the central leg 8*d*1 and the pair of outside legs 8*d*2.

Herein, in the drive lever 9 which has the rotation shaft portion 9*a* rotatably engaged with the inner wall of the arc extinguishing cover 5 and the movable core connection portion 9*b* engaged with the connection hole 8*e* of the movable core 8*d*, the movable contact support connection portion 9*c* provided in the central portion in the longitudinal direction is disposed to be engageable with the inner wall of a lever connection hole 7*a*5 which vertically extends on one end side of the movable contact support 7*a*.

The movable core 8*d* urged in the direction in which the movable core 8*d* is moved away from the fixed core 8*c* by the movable core spring 21 is held to contact with the inner wall of the lower case 3 when the exciting coil 8*a* of the electromagnet 8 is in the non-excited state, and the position of the movable core 8*d* contacting with the inner wall of the lower case 3 is the initial position of the movable core 8*d*. When the movable core 8*d* is held at the initial position in this manner, as shown in FIG. 1, the movable contact support connection portion 9*c* of the drive lever 9 opposes the inner wall of the opposing lever connection hole 7*a*5 with at least a gap A provided therebetween.

Herein, the movable core spring 21 corresponds to a compression coil spring of the present invention, the major diameter end portion 21*a* corresponds to a coil major diameter end portion of the present invention, and the initial position of the movable core 8*d* corresponds to a movable core initial position of the present invention.

Figure 4:
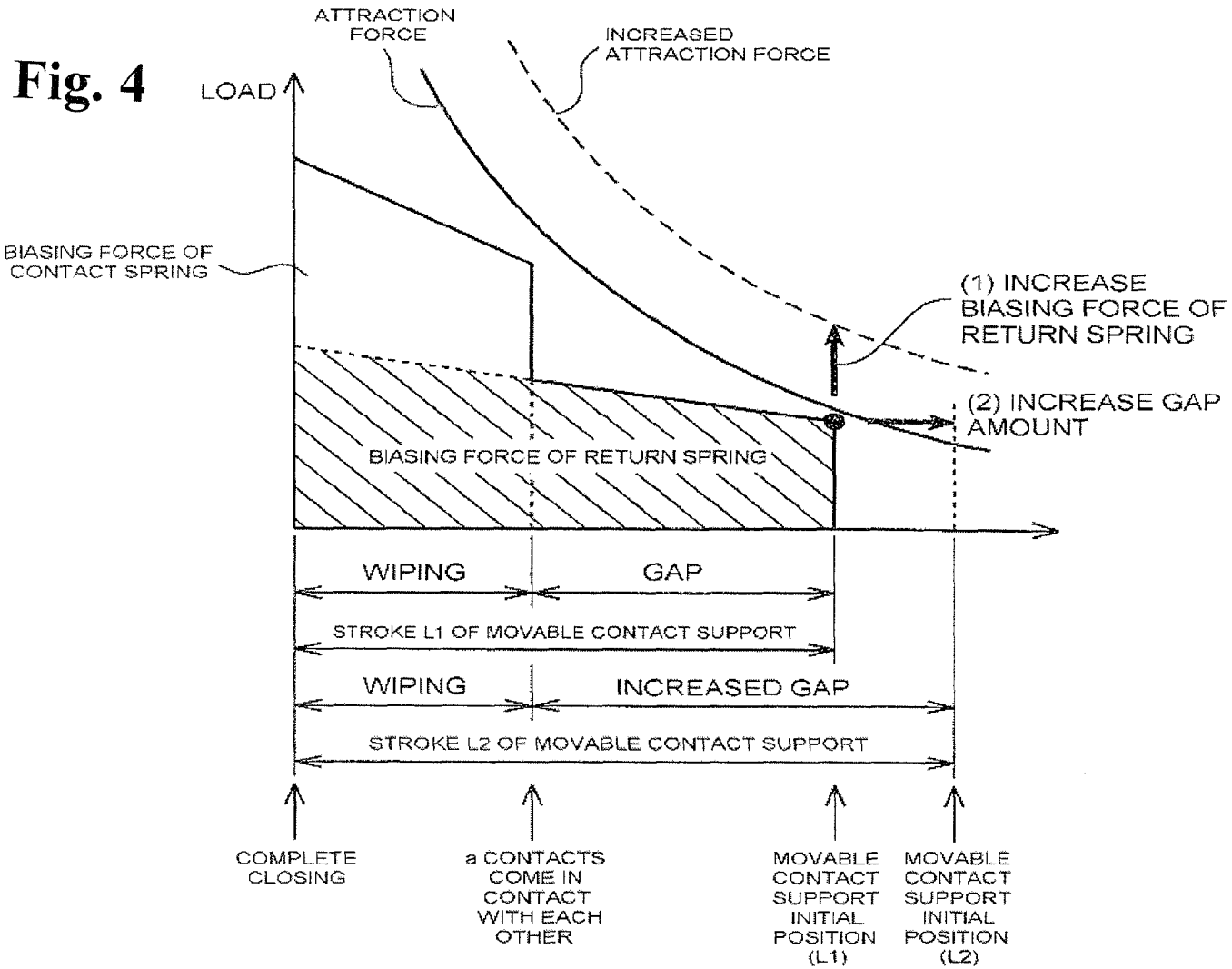
FIG. 4 is a graph for explaining an operation of a conventional electromagnetic contactor.
Figure 5:
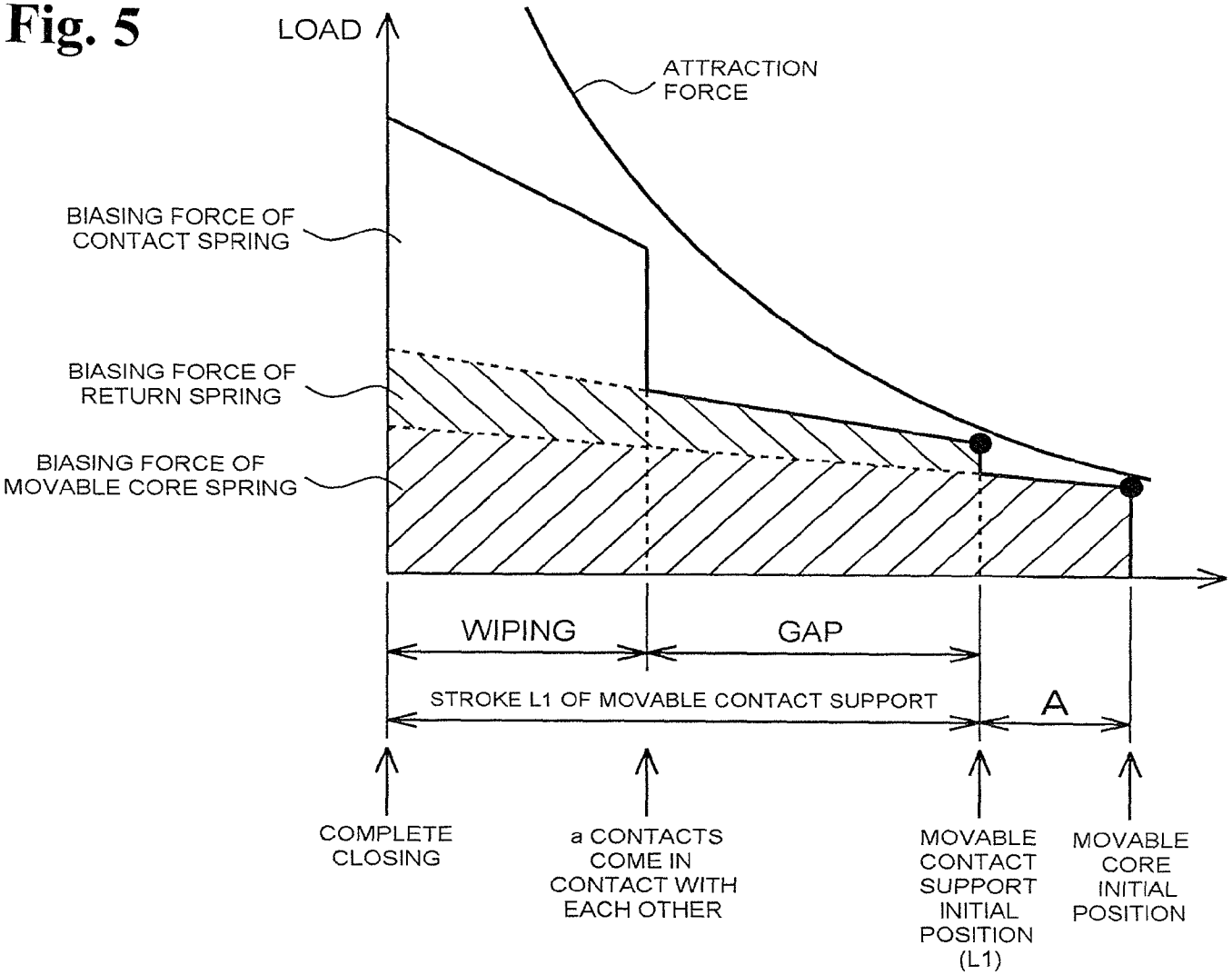
FIG. 5 is a graph for explaining an operation of the electromagnetic contactor according to the present invention.

Next, a description is given of the operation and effect of the electromagnetic contactor 20 of the present embodiment in comparison with the conventional electromagnetic contactor with reference to FIGS. 4 and 5.

Figure 6:
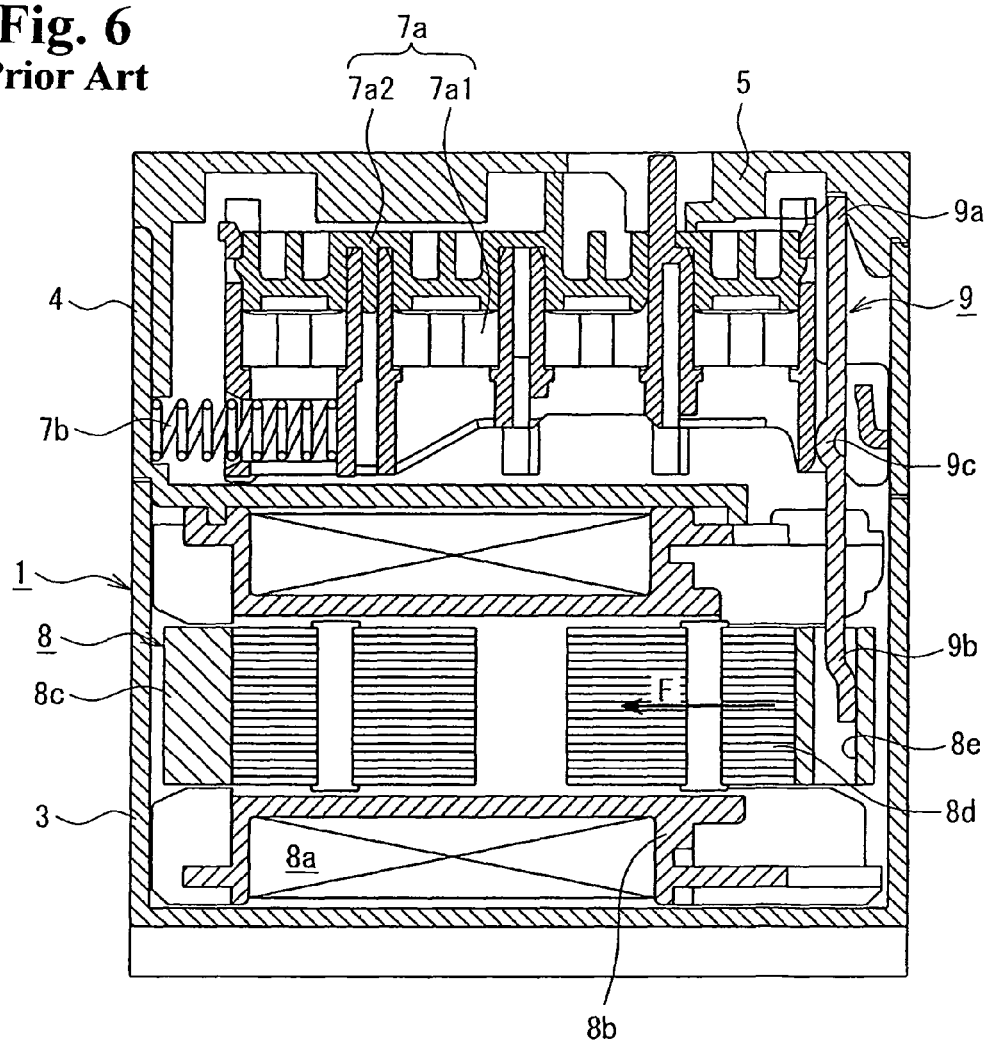
Fig. 6 Prior Art
FIG. 6 is a cross-sectional view showing an initial state of the conventional electromagnetic contactor.
Figure 7:
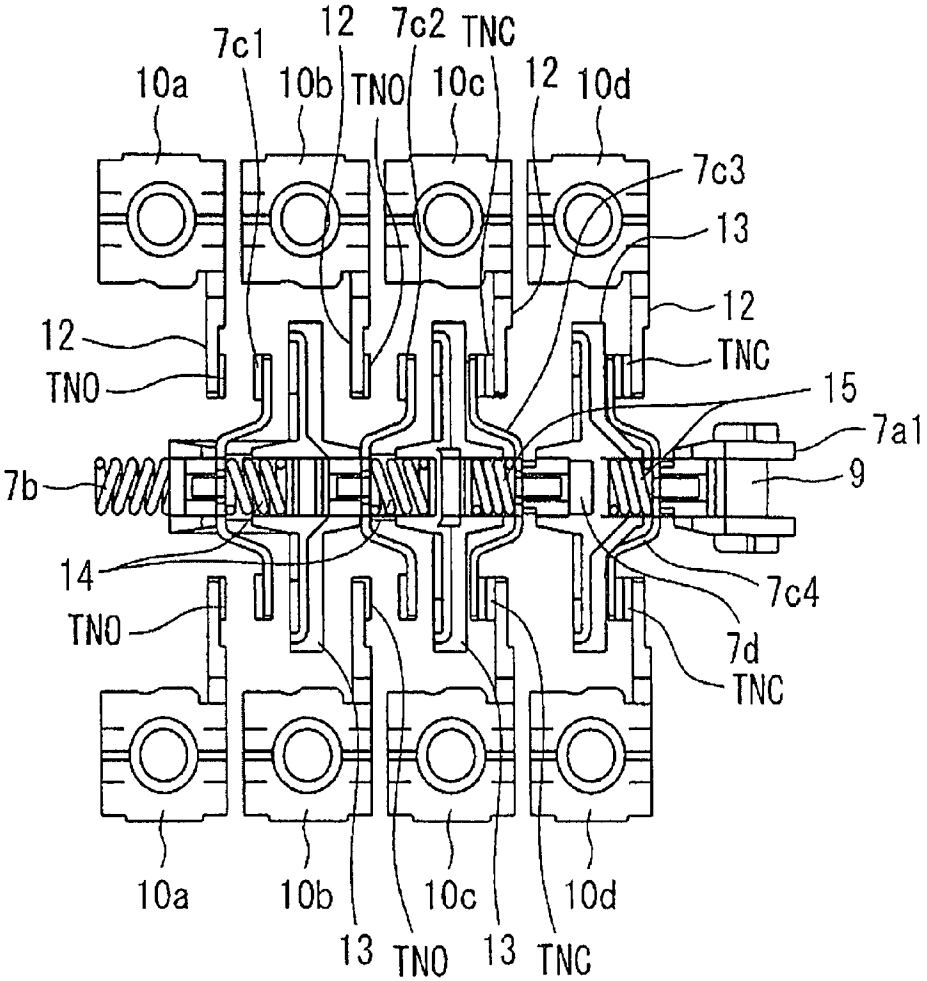
Fig. 7 Prior Art
FIG. 7 is a schematic diagram showing a contact portion of the electromagnetic contactor.

FIG. 4 relates to the conventional electromagnetic contactor 1 shown in FIG. 6, and is a graph showing the operation of the a contacts (the movable contacts 7*c*1 and 7*c*2 and the normally open fixed contacts TNO of the terminal portions 10*a* and 10*b*) and a change in load applied to the movable contact support 7*a* (the urging force of the return spring 7*b* and the contact springs 14 in a wiping state of the a contacts) when the attraction force is generated in the electromagnet 8 and the movable contact support 7*a* moves a distance corresponding to its stroke from the initial position to the contact switching position to establish complete closing.

As the countermeasure against the malfunction of the conventional electromagnetic contactor 1 resulting from the impact from the outside, as described above, there may be adopted the prevention of the temporary disconnection of the b contacts by having the return spring with the increased urging force (see (1) in FIG. 4). However, when the urging force of the return spring is increased, the electromagnet having a large attraction force is required (the attraction force indicated by the broken line in FIG. 4), and it is not possible to achieve a reduction in size in the case of the electromagnetic contactor having the large electromagnet.

In addition, as another countermeasure against the malfunction resulting from the impact from the outside, although there may be adopted the setting of the gap amount between the contacts of the a contacts to a larger value (see (2) in FIG. 4), a stroke L2 of the movable contact support 7*a* having the increased gap amount between the contacts of the a contacts is increased so that the dimension of the outer diameter of the upper case 4 accommodating the movable contact support 7*a* having the stroke L2 is increased, and hence it is not possible to achieve a reduction in the size of the electromagnetic contactor.

On the other hand, FIG. 5 relates to the electromagnetic contactor 20 of the present embodiment, and is a graph showing the operation of the a contacts (the movable contacts 7*c*1 and 7*c*2 and the normally open fixed contacts TNO of the terminal portions 10*a* and 10*b*) and a change in load applied to the movable contact support 7*a* (the urging force of the movable core spring 21, the return spring 22, and the contact springs 14 in the wiping state of the a contacts) when the attraction force is generated in the electromagnet 8 and the movable contact support 7*a* moves a distance corresponding to its stroke from the initial position to the contact switching position to establish the complete closing.

In the present embodiment, the movable core 21, when the exciting coil 8*a* of the electromagnet 8 is in the non-excited state and the attraction force is not generated between the movable core 21 and the fixed core 8*c*, is held at the initial position which does not allow the engagement with the movable contact support 7*a* by the action of the urging force from the movable core spring 21 (see FIG. 1).

The distance which allows the movable core 21 at the initial position to be engaged with the movable contact support 7*a* (the distance between the initial position of the movable core 21 and the initial position of the movable contact support 7*a*) is equal to the gap A between the movable contact support connection portion 9*c* of the drive lever 9 and the inner wall of the lever connection hole 7*a*5 shown in FIG. 1 (hereinafter referred to as an engagement distance A).

In the present embodiment, the movable core 8*d* which moves by the impact from the outside is engaged with the movable contact support 7*a* after having moved the engagement distance A from the initial position at which the movable core 8*d* is held by the movable core spring 21 so that the movement distance required to cause the b contacts to be disconnected is increased, and hence it is possible to enhance operation reliability against the impact.

In addition, it is not necessary to increase the gap amount between the contacts of the a contacts in order to enhance the operation reliability against the impact so that a stroke L1 of the movable contact support 7*a* is not increased and the dimension of the outer diameter of the upper case 4 accommodating the movable contact support 7*a* is not increased, and hence it is possible to achieve a reduction in the size of the electromagnetic contactor 20.

Further, the return spring 22 generates the urging force acting on the movable contact support 7*a* toward the initial position in cooperation with the movable core spring 21 in a sharing manner, and the urging force obtained by adding up the respective urging forces of the movable core spring 21 and the return spring 22 is equal to that of the return spring 7*b* shown in FIG. 6, and hence the electromagnet 8 capable of generating the large attraction force is not required, and it is possible to achieve a further reduction in the size of the electromagnetic contactor 20.

Furthermore, the movable core spring 21 is disposed in the state where the central leg 8*d*1 of the movable core 8*d* is inserted thereinto and the both end portions thereof are contacting with the end surface on the other end side of the coil frame 8*b* and the core base portion 8*d*3, and hence it is possible to effectively use a space around the movable core 8*d* as a space for accommodating the movable core spring 21 and achieve a further reduction in the size of the electromagnetic contactor 20.

Moreover, the movable core spring 21 in the conical coil shape is not decentered when compressed and the coil minor diameter portion thereof enters into the coil major diameter portion thereof, and hence it is possible to apply a linear urging force to the movable core 8*d*.

Additionally, the movable core spring 21 in the conical coil shape has the major diameter end portion 21*a* contacting with the wall surface of the core base portion 8*d*3 positioned between the central leg 8*d*1 and the pair of outside legs 8*d*2 so that the contact area with the movable core 8*d* which performs the attraction movement and the release movement is increased, and hence it is possible to prevent the movable core spring 21 from being decentered when compressed or extended to improve the durability thereof.

INDUSTRIAL APPLICABILITY

Thus, the electromagnetic contactor according to the present invention is useful for enhancing the operation reliability against the impact and achieving the reduction in size.

EXPLANATION OF REFERENCE NUMERALS

3 . . . lower case, 4 . . . upper case, 5 . . . arc extinguishing cover, 7*a* . . . movable contact support, 7*a*1 . . . movable contact support base, 7*a*2 . . . movable contact support cover, 7*a*5 . . . lever connection hole, 7*c*1 to 7*c*4 . . . movable contact, 8 . . . electromagnet, 8*a* . . . exciting coil, 8*b* . . . coil frame, 8*b*1 . . . hollow portion, 8*c* . . . fixed core, 8*c*1 . . . central leg, 8*c*2 . . . outside leg, 8*c*3 . . . core base portion, 8*d* . . . movable core, 8*d*1 . . . central leg, 8*d*2 . . . outside leg, 8*d*3 . . . core base portion, 8*e* . . . connection hole, 9 . . . drive lever, 9*a* . . . rotation shaft portion, 9*b* . . . movable core connection portion, 9*c* . . . movable contact support connection portion, 10*a* to 10*d* terminal portion, 11 coil terminal, contact piece, 13 . . . partition, 14, 15 . . . contact spring, 20 . . . electromagnetic contactor, 21 . . . movable core spring, 21*a* . . . major diameter end portion, 22 . . . return spring, TNO . . . normally open fixed contact, TNC . . . normally closed fixed contact

What is claimed is:

1. An electromagnetic contactor accommodating, in a case, an electromagnet having a movable core performing an attraction movement by a generation of an attraction force between the movable core and a fixed core, a movable contact support moving between an initial position and a contact switching position in parallel with a movement direction of the movable core, a return spring urging the movable contact support toward the initial position, and a drive lever engaging the movable core and the movable contact support, and transmitting the attraction movement of the movable core with respect to the movable contact support as a movement toward the switching position, wherein the electromagnetic contactor includes an urging portion applying an urging force to the movable core to hold the movable core at the movable core initial position, which is apart from the fixed core and does not engage the movable contact support, the electromagnet comprises a coil frame having a hollow portion with a coil wound around, and the movable core formed in substantially an E shape and disposed to face the fixed core on one end side of the coil frame, the movable core having a central leg inserted into the hollow portion of the coil frame from a core base portion, and a pair of outside legs sandwiching the central leg, and the urging portion is a compression coil spring having two ends in an axial direction contacting with a wall surface on one end side of the coil frame and the core base portion of the movable core in a state where the central leg of the movable core is inserted into the conical coil spring, and the compression coil spring is a conical coil spring.

2. An electromagnetic contactor according to claim 1, wherein a coil major diameter end portion of the conical coil spring contacts the core base portion of the movable core.

3. An electromagnetic contactor according to claim 1, wherein an urging force urging the movable contact support toward the initial position is a force combining the urging force of the urging portion transmitted to the movable contact support via the movable core and the drive lever and an urging force of the return spring.

4. An electromagnetic contactor according to claim 1, wherein the drive lever has a gap with respect to a contact portion of the movable contact support.

* * * * *